US007731832B2

(12) United States Patent
Yamaguchi

(10) Patent No.: US 7,731,832 B2
(45) Date of Patent: Jun. 8, 2010

(54) METHOD FOR MANUFACTURING GRINDING WHEEL CONTAINING HOLLOW PARTICLES ALONG WITH ABRASIVE GRAINS

(75) Inventor: Takashi Yamaguchi, Tokyo (JP)

(73) Assignee: Disco Corporation, Tokyo (JP)

( * ) Notice: Subject to any disclaimer, the term of this patent is extended or adjusted under 35 U.S.C. 154(b) by 877 days.

(21) Appl. No.: 11/598,061

(22) Filed: Nov. 13, 2006

(65) Prior Publication Data

US 2007/0051049 A1 Mar. 8, 2007

Related U.S. Application Data

(62) Division of application No. 11/128,196, filed on May 13, 2005, now abandoned.

(30) Foreign Application Priority Data

May 19, 2004 (JP) ..... 2004-148839

(51) Int. Cl.
*B24D 3/10* (2006.01)
*B24D 3/34* (2006.01)
*C25D 15/00* (2006.01)

(52) U.S. Cl. ..... 205/110; 205/170; 51/308; 51/309

(58) Field of Classification Search ..... 205/110
See application file for complete search history.

(56) References Cited

U.S. PATENT DOCUMENTS 2,360,798 A * 10/1944 Seligman et al. ..... 205/110
3,785,938 A * 1/1974 Sam ..... 205/110
3,957,593 A * 5/1976 Haack ..... 205/110
4,302,300 A * 11/1981 Chamska et al. ..... 205/110
4,547,998 A * 10/1985 Kajiyama ..... 451/541
5,658,194 A 8/1997 Micheletti ..... 451/541
5,989,405 A * 11/1999 Murata et al. ..... 205/110
6,306,274 B1 * 10/2001 Kajiyama ..... 205/67
6,394,888 B1 5/2002 Matsumoto et al. ..... 451/548
2003/0097800 A1 5/2003 Ramanath et al. ..... 51/309

FOREIGN PATENT DOCUMENTS

CN 1368912 A 9/2002

* cited by examiner

*Primary Examiner*—Harry D Wilkins, III
(74) *Attorney, Agent, or Firm*—Smith, Gambrell & Russell, LLP

(57) ABSTRACT

A grinding wheel having hollow particles, along with abrasive grains, fixed by a bonding material. The abrasive grains may be diamond grains. The hollow particles may consist essentially of silica. The bonding material may be electrodeposited nickel. The grinding wheel is manufactured by performing an abrasive grain electrodeposition step of immersing a base, with a plating surface being pointed upward, in a plating solution, in which the abrasive grains having a larger specific gravity than the plating solution are dispersed, to deposit the abrasive grains settling in the plating solution on the plating surface, and also deposit a plating metal on the plating surface; and a hollow particle electrodeposition step of immersing the base, with the plating surface being pointed downward, in a plating solution, in which the hollow particles having a smaller specific gravity than the plating solution are dispersed, to deposit the hollow particles floating in the plating solution on the plating surface, and also deposit a plating metal on the plating surface.

5 Claims, 5 Drawing Sheets

METHOD FOR MANUFACTURING GRINDING WHEEL CONTAINING HOLLOW PARTICLES ALONG WITH ABRASIVE GRAINS

CROSS REFERENCE TO RELATED APPLICATION

This application is a division of Ser. No.11/128,196, filed May 13, 2005 now abandoned and which is being incorporated in its entirety herein by reference.

FIELD OF THE INVENTION

This invention relates to a grinding wheel having abrasive grains, such as diamond grains, fixed thereto by a bonding material, and a method for manufacturing the grinding wheel.

DESCRIPTION OF THE PRIOR ART

As well known among people skilled in the art, grinding wheels of various shapes, which comprise abrasive grains, such as diamond grains, fixed by a suitable bonding material such as a plating metal, are used for cutting and grinding hard and brittle materials, such as a silicon wafer, a sapphire wafer, a ceramics plate, and a glass plate.

According to the inventor's experience, conventional grinding wheels of the above-mentioned forms have the abrasive grains firmly fixed. Thus, the abrasive grains decreased in cutting or grinding capacity are kept retained, without being suitably released, resulting in an excessively low self-sharpening effect. Hence, the conventional grinding wheels pose the problem that dressing has to be performed frequently in order to maintain high cutting or grinding capacity.

SUMMARY OF THE INVENTION

It is a first object of the present invention, therefore, to provide a grinding wheel in which abrasive grains decreased in cutting or grinding capacity are suitably released to produce a sufficient self-sharpening effect.

It is a second object of the present invention to provide a manufacturing method which can advantageously produce the above-described grinding wheel.

Based on eager studies and experiments, the inventor has found that when hollow particles along with abrasive grains are fixed by a bonding material to produce a grinding wheel, the degree of fixing of the abrasive grains is suitably decreased because of the presence of the hollow particles, with the result that the abrasive grains decreased in cutting or grinding capacity are suitably released to exert a sufficient self-sharpening effect.

According to a first aspect of the present invention, there is provided, as a grinding wheel for attaining the above first object, a grinding wheel having hollow particles, along with abrasive grains, fixed by a bonding material.

Preferably, the abrasive grains comprise diamond grains, the hollow particles consist essentially of silica, and the bonding material is a plating metal. The metal is preferably nickel. It is preferred that the proportion by volume of the abrasive grains is 10 to 30%, especially 15 to 25%, and the proportion by volume of the hollow particles is 10 to 50%, especially 20 to 40%.

According to a second aspect of the present invention, there is provided, as a manufacturing method for attaining the above second object, a method for manufacturing a grinding wheel having hollow particles, along with abrasive grains, electrodeposited, comprising:

an abrasive grain electrodeposition step of immersing a base, with a plating surface thereof being pointed upward, in a plating solution, in which the abrasive grains having a larger specific gravity than the plating solution are dispersed, to deposit the abrasive grains settling in the plating solution on the plating surface, and also deposit a plating metal on the plating surface; and a hollow particle electrodeposition step of immersing the base, with the plating surface being pointed downward, in a plating solution, in which the hollow particles having a smaller specific gravity than the plating solution are dispersed, to deposit the hollow particles floating in the plating solution on the plating surface, and also deposit a plating metal on the plating surface.

Preferably, the abrasive grain electrodeposition step and the hollow particle electrodeposition step are alternately repeated a plurality of times.

DETAILED DESCRIPTION OF THE PREFERRED EMBODIMENTS

The preferred embodiments of the present invention will now be described in greater detail with reference to the accompanying drawings.

Figure 1:
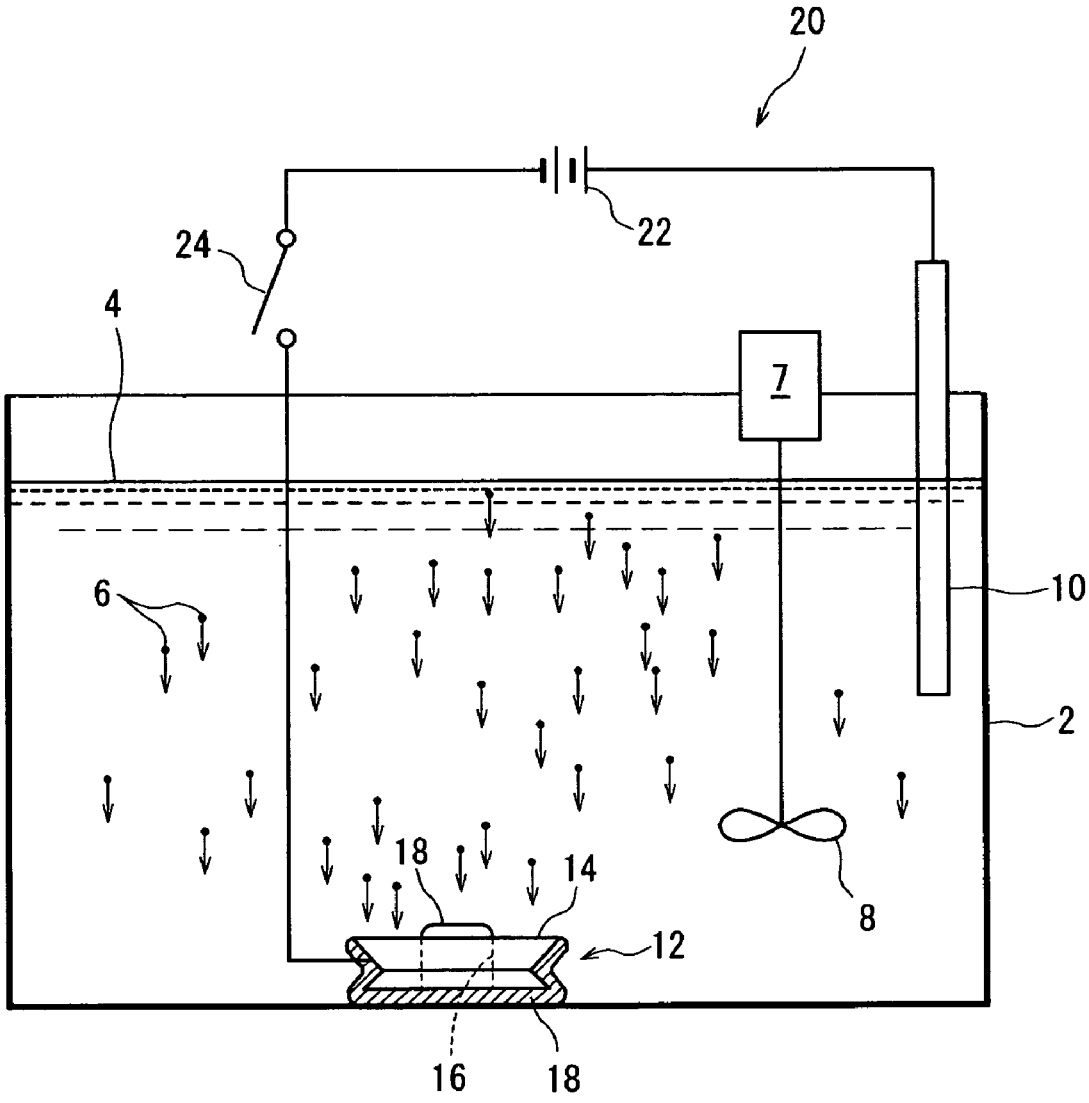
FIG. 1 is a schematic view showing an abrasive grain electrodeposition step in a preferred embodiment of the manufacturing method according to the present invention.

FIG. 1 schematically shows an abrasive grain electrodeposition step in a preferred embodiment of a method for manufacturing a grinding wheel constructed in accordance with the present invention. In this abrasive grain electrodeposition step, an electroplating device furnished with a plating tank 2 is used. The plating tank 2 accommodates a plating solution 4 such as a nickel sulfate solution. The plating solution 4 contains abrasive grains 6. The plating tank 2 is provided with a stirring means 8 rotationally driven by a drive source 7 which may be an electric motor. A metal bar 10, which is preferably made of nickel, is partly immersed in the plating solution 4. A base 12, which is formed from a suitable metal such as aluminum, is placed at the bottom of the plating tank 2. The base 12 in the illustrated embodiment, as will be clearly understood by reference to FIG. 3 along with FIG. 1, has an inverted truncated conical upper portion and a truncated conical lower portion, and has a substantially flat plating surface 14 formed on a side surface thereof (an upper surface in FIGS. 1 and 3). A through-hole 16 is formed at the center of the base 12. Prior to placement of the base 12 in the plating tank 2, the base 12 has an entire surface (except the plating surface 14) coated with a masking material 18 composed of a suitable insulating material. The electroplating device is also equipped with a voltage application means 20 for applying a direct current voltage between the metal bar 10 and the base 12. The voltage application means 20 includes a direct current voltage source 22 and an on/off switch 24.

In the abrasive grain electrodeposition step, the stirring means 8 is rotationally driven, with the switch 24 being open. As a result, the plating solution 4 containing the abrasive grains 6 is stirred to disperse the abrasive grains 6 in the plating solution 4. In FIG. 1, only some of the dispersed abrasive grains 6 are schematically shown. Then, the rotational driving of the stirring means 8 is stopped, and the switch 24 is closed. In this situation, nickel is deposited on the plating surface 14 of the base 12 by an electroplating action to carry out plating. Since the specific gravity of the abrasive grains 6 is higher than the specific gravity of the plating solution 4, the abrasive grains 6 dispersed in the plating solution 4 settle in the plating solution 4, so that the abrasive grains 6 are also deposited on the plating surface 14 of the base 12. Consequently, an abrasive grain electrodeposition layer comprising the abrasive grains 6 fixed by the nickel plating is formed on the plating surface 14 of the base 12.

The abrasive grains 6 may have a grain size of the order of 10 to 15 μm measured, for example, by the laser diffraction/scattering method.

Figure 2:
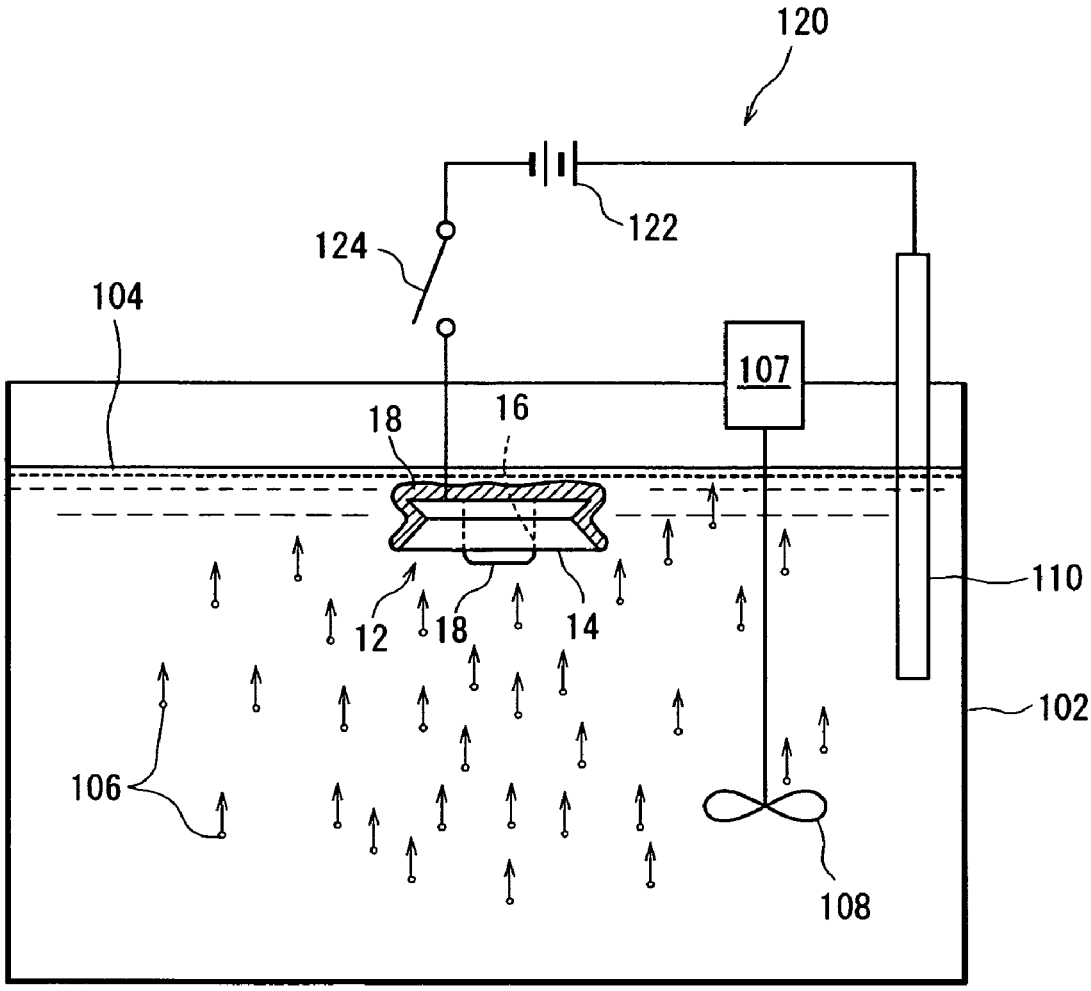
FIG. 2 is a schematic view showing a hollow particle electrodeposition step in the preferred embodiment of the manufacturing method according to the present invention.

FIG. 2 schematically shows a hollow particle electrodeposition step in the preferred embodiment of the method for manufacturing the grinding wheel constructed in accordance with the present invention. In this hollow particle electrodeposition step as well, an electroplating device furnished with a plating tank 102 is used. The plating tank 102 accommodates a plating solution 104 such as a nickel sulfate solution. The plating solution 104 contains hollow particles 106. The plating tank 102 is provided with a stirring means 108 rotationally driven by a drive source 107 which may be an electric motor. A metal bar 110, which is preferably made of nickel, is partly immersed in the plating solution 104. The base 12, which has had the abrasive grain electrodeposition layer formed on the plating surface 14 in the aforementioned abrasive grain electrodeposition step, is immersed, with its plating surface 14 being pointed downward, in an upper layer part of the plating solution 104 accommodated in the plating tank 102. The electroplating device is also equipped with a voltage application means 120 for applying a direct current voltage between the metal bar 110 and the base 12. The voltage application means 120 includes a direct current voltage source 122 and an on/off switch 124.

In the hollow particle electrodeposition step, the stirring means 108 is rotationally driven, with the switch 124 being open. As a result, the plating solution 104 containing the hollow particles 106 is stirred to disperse the hollow particles 106 in the plating solution 104. In FIG. 2, only some of the dispersed hollow particles 106 are schematically shown. Then, the rotational driving of the stirring means 108 is stopped, and the switch 124 is closed. In this situation, nickel is deposited on the plating surface 14 of the base 12 by an electroplating action to carry out plating. Since the specific gravity of the hollow particles 106 is lower than the specific gravity of the plating solution 104, the hollow particles 106 dispersed in the plating solution 104 float in the plating solution 104, so that the hollow particles 106 are also deposited on the plating surface 14 of the base 12. Consequently, a hollow particle electrodeposition layer comprising the hollow particles 106 fixed by the nickel plating is formed on the plating surface 14 of the base 12.

Preferably, the hollow particles 106 are hollow spherical bodies consisting essentially of silica (proportion by weight: 60 to 80%), and have a particle size of the order of 20 to 50 μm measured, for example, by the laser diffraction/scattering method. Preferably usable as the hollow particles 106 are hollow particles marketed by Taiheiyo Cement under the trade name of "E-SPHERES", hollow particles marketed by Towana under the trade name of "Shirasu-balloons", hollow particles marketed by Public Strategy under the trade name of "SILAX BALLOON", and hollow particles marketed by SUZUKI YUSHI INDUSTRIAL under the trade name of "GOD BALL".

Figure 3:
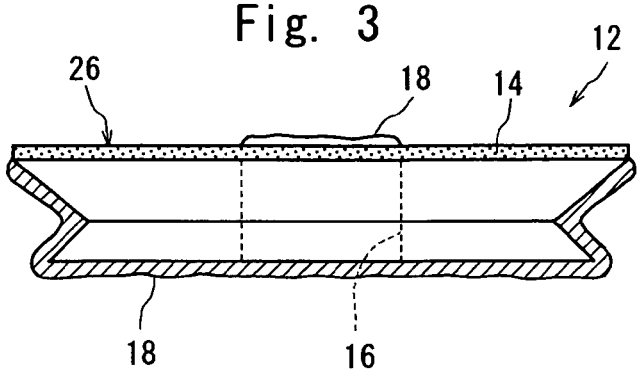
FIG. 3 is a sectional view showing a state in which a grinding wheel is formed on a plating surface of a base by repeating the abrasive grain electrodeposition step, shown in FIG. 1, and the hollow particle electrodeposition step, shown in FIG. 2, alternately a plurality of times.
Figure 4:
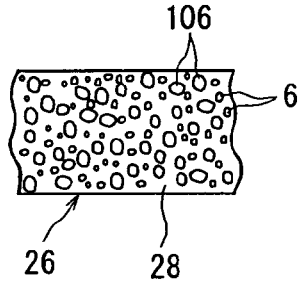
FIG. 4 is an enlarged view showing a part of the grinding wheel shown in FIG. 3.

FIG. 3 shows a state in which a grinding wheel 26 having the abrasive grains 6 and the hollow particles 106 fixed by the nickel plating by the above-described abrasive grain electrodeposition step and hollow particle electrodeposition step alternately repeated a plurality of times is disposed on the plating surface 14 of the base 12. FIG. 4 is an enlarged view showing a part of the grinding wheel 26. In the grinding wheel 26, as clearly understood from FIG. 4, the abrasive grains 6 and the hollow particles 106 are suitably dispersed in plated nickel 28. Generally, the abrasive grains 6 account for 10 to 30% by volume, the hollow particles 106 account for 10 to 50% by volume, and the remainder being plated nickel, advantageously.

Figure 5:
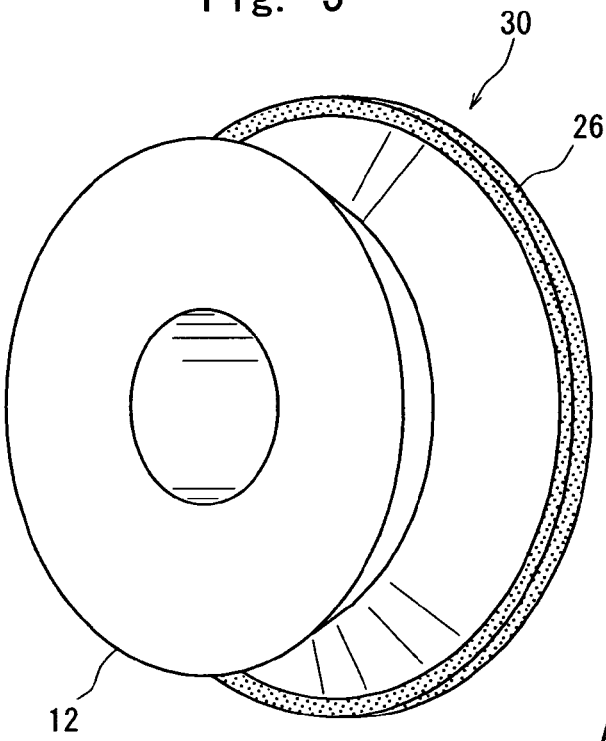
FIG. 5 is a perspective view showing a cutting tool composed of the base and the grinding wheel.
Figure 6:
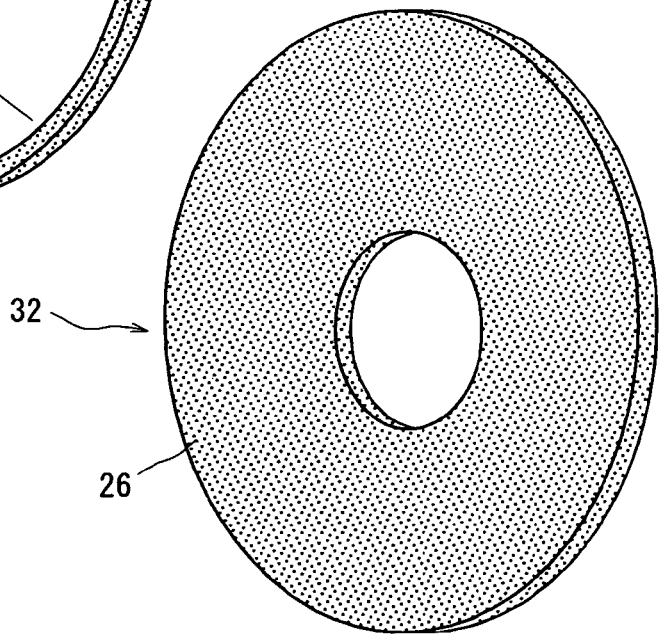
FIG. 6 is a perspective view showing a cutting tool composed of the grinding wheel alone.

When the masking material 18 is removed from the base 12 shown in FIG. 3 and, further, a part of the base 12, namely, an outer peripheral edge portion of the upper end of the base 12, is removed in a manner well known per se, such as dissolution with a sodium hydroxide solution, a cutting tool 30 as shown in FIG. 5 can be formed. The cutting tool 30 is composed of the base 12, and the grinding wheel 26 disposed on a surface (i.e., the plating surface 14) of the base 12, and an outer peripheral edge portion of the grinding wheel 26 protrudes from the base 12. If the whole of the base 12 is removed, a cutting tool 32, composed only of the grinding wheel 26 of an annular thin plate shape, can be formed, as shown in FIG. 6.

Figure 7:
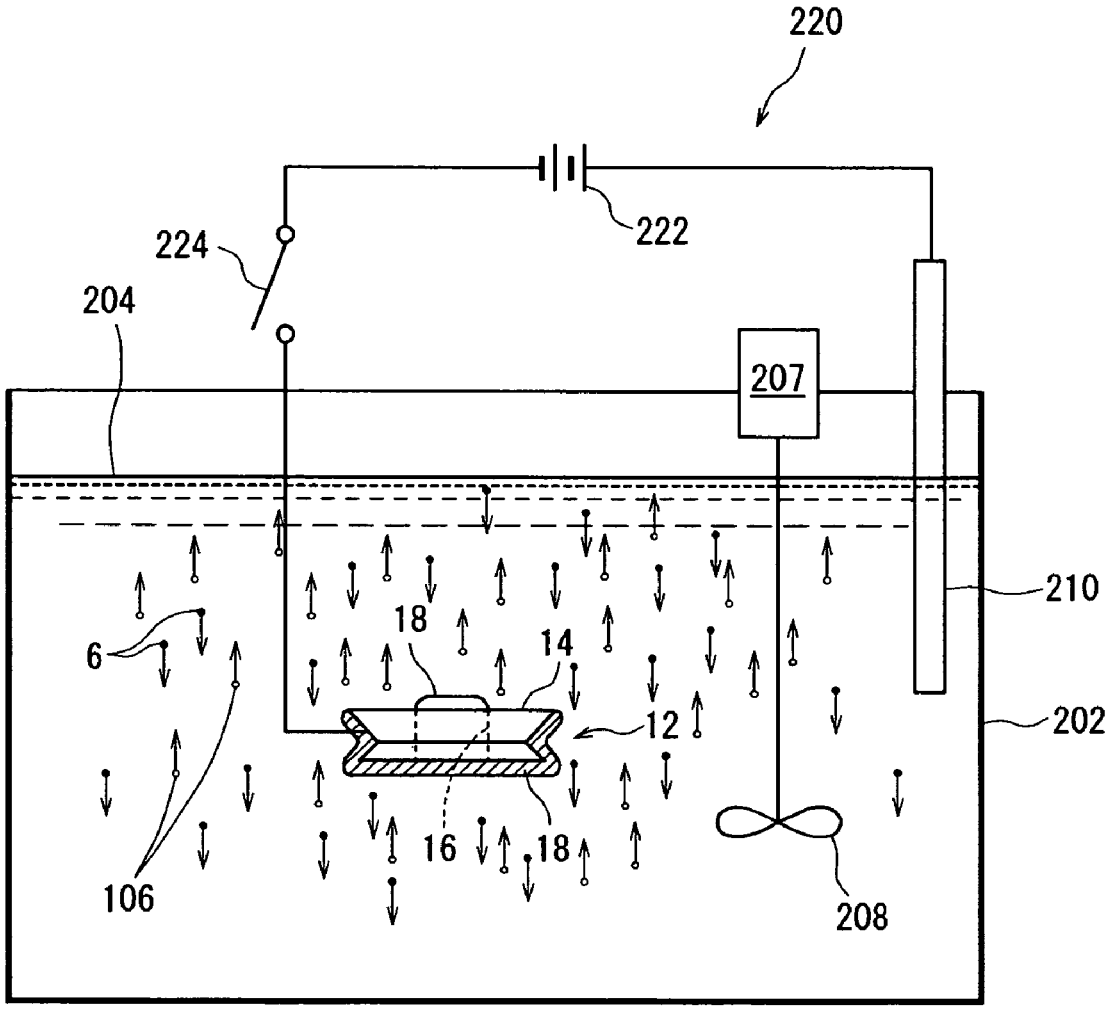
FIG. 7 is a schematic view showing the abrasive grain electrodeposition step in another embodiment of the manufacturing method according to the present invention.

FIG. 7 schematically shows an abrasive grain electrodeposition step in other embodiment of the method for manufacturing the grinding wheel constructed in accordance with the present invention. In the abrasive grain electrodeposition step shown in FIG. 7 as well, an electroplating device furnished with a plating tank 202 is used. The plating tank 202 accommodates a plating solution 204 such as a nickel sulfate solution. The plating solution 204 contains hollow particles 106 along with abrasive grains 6. The abrasive grains 6 and the hollow particles 106 are substantially the same as the abrasive grains 6 and the hollow particles 106 shown in FIGS. 1 to 3. The plating tank 202 is provided with a stirring means 208 rotationally driven by a drive source 207 which may be an electric motor. A metal bar 210, which is preferably made of nickel, is partly immersed in the plating solution 204. A base 12 is immersed, with its plating surface 14 being pointed upward, in an intermediate portion in the depth direction of the plating solution 204 accommodated in the plating tank 202. This base 12 is substantially the same as the base 12 illustrated in FIGS. 1 to 3. The electroplating device is also equipped with a voltage application means 220 for applying a direct current voltage between the metal bar 210 and the base 12. The voltage application means 220 includes a direct current voltage source 222 and an on/off switch 224.

In the abrasive grain electrodeposition step, the stirring means 208 is rotationally driven, with the switch 224 being open. As a result, the plating solution 204 containing the abrasive grains 6 and the hollow particles 106 is stirred to disperse the abrasive grains 6 and the hollow particles 106 in the plating solution 204. Then, the rotational driving of the stirring means 208 is stopped, and the switch 224 is closed. In this situation, nickel is deposited on the plating surface 14 of the base 12 by an electroplating action to carry out plating. Since the specific gravity of the abrasive grains 6 is greater than the specific gravity of the plating solution 204, the abrasive grains 6 dispersed in the plating solution 204 settle in the plating solution 204, so that the abrasive grains 6 are deposited on the plating surface 14 of the base 12. Consequently, an abrasive grain electrodeposition layer comprising the abrasive grains 6 fixed by the nickel plating is formed on the plating surface 14 of the base 12. Since the specific gravity of the hollow particles 106 is lower than the specific gravity of the plating solution 204, on the other hand, the hollow particles 106 float in the plating solution 204, and do not deposit on the plating surface 14 of the base 12.

Figure 8:
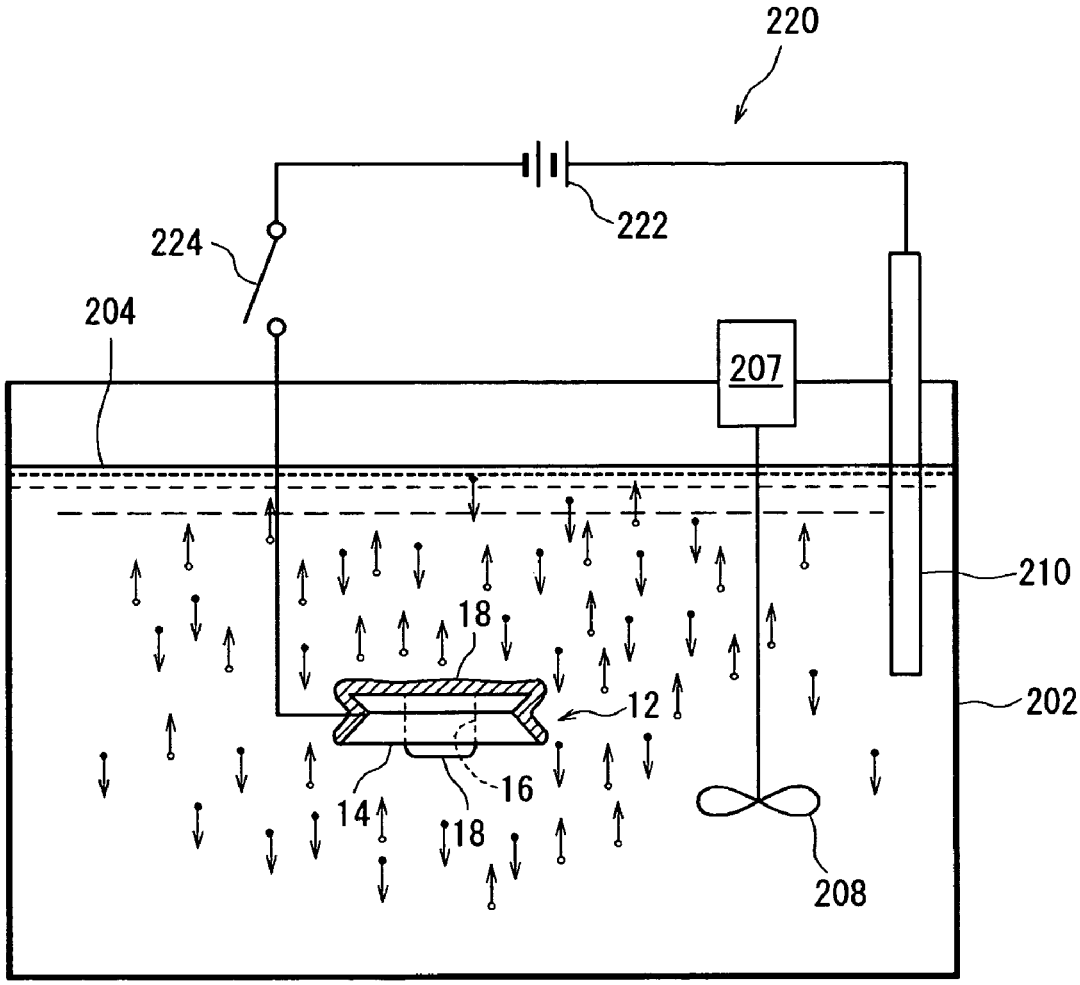
FIG. 8 is a schematic view showing the hollow particle electrodeposition step in still another embodiment of the manufacturing method according to the present invention.

In the hollow particle electrodeposition step, the base 12 in the plating solution 204 is turned upside down to point downward the plating surface 14 of the base 12, as shown in FIG. 8. Then, the stirring means 208 is rotationally driven, with the switch 224 being open. As a result, the plating solution 204 containing the abrasive grains 6 and the hollow particles 106 is stirred to disperse the abrasive grains 6 and the hollow particles 106 in the plating solution 204. Then, the rotational driving of the stirring means 208 is stopped, and the switch 224 is closed. In this situation, nickel is deposited on the plating surface 14 of the base 12 by an electroplating action to carry out plating. Since the specific gravity of the hollow particles 106 is lower than the specific gravity of the plating solution 204, the hollow particles 106 dispersed in the plating solution 204 float in the plating solution 204, so that the hollow particles 106 are deposited on the plating surface 14 of the base 12. Consequently, a hollow particle electrodeposition layer comprising the hollow particles 106 fixed by the nickel plating is formed on the plating surface 14 of the base 12. The specific gravity of the abrasive grains 6 is greater than the specific gravity of the plating solution 204. Thus, the abrasive grains 6 settle in the plating solution 204, and do not deposit on the plating surface 14 of the base 12.

If the above-described abrasive grain electrodeposition step and hollow particle electrodeposition step are alternately repeated a plurality of times, the grinding wheel 26 having the abrasive grains 6 and the hollow particles 106 fixed by the nickel plating can be disposed on the plating surface 14 of the base 12, as shown in FIG. 3.

While the preferred embodiments of the grinding wheel constructed according to the present invention, and the preferred embodiments of the method for manufacturing the grinding wheel have been described in detail by reference to the accompanying drawings, it is to be understood that the invention is not limited to such embodiments, but various changes and modifications may be made without departing from the scope of the present invention.

For example, the grinding wheel in the shape of an annular thin plate has been described. However, the grinding wheel of such a shape is not restrictive, and the present invention can be applied to grinding wheels of various shapes. Moreover, the electrodeposited grinding wheel having the abrasive grains and the hollow particles fixed by the plating metal has been described. However, the present invention can be applied to grinding wheels using bonding materials other than the plating metal, such as a resin-based bonding material and a vitrified bonding material.

What I claim is:

1. A method for manufacturing a grinding wheel having hollow particles, along with abrasive grains, electrodeposited, comprising:

an abrasive grain electrodeposition step of immersing a base, with a plating surface being pointed upward, in a plating solution, in which the abrasive grains having a larger specific gravity than the plating solution are dispersed, to deposit the abrasive grains settling in the plating solution on the plating surface, and also deposit a plating metal on the plating surface; and a hollow particle electrodeposition step of immersing the base, with the plating surface being pointed downward, in a plating solution, in which the hollow particles having a smaller specific gravity than the plating solution are dispersed, to deposit the hollow particles floating in the plating solution on the plating surface, and also deposit a plating metal on the plating surface.

2. The method for manufacturing according to claim 1, wherein the abrasive grain electrodeposition step and the hollow particle electrodeposition step are alternately repeated a plurality of times.

3. The method for manufacturing according to claim 1, wherein the abrasive grains comprise diamond grains.

4. The method for manufacturing according to claim 1, wherein the hollow particles consist essentially of silica.

5. The method for manufacturing according to claim 1, wherein the plating metal is nickel.

* * * * *